US005899503A

United States Patent [19]

Yoshizawa

[11] Patent Number: 5,899,503

[45] Date of Patent: May 4, 1999

[54] GEM CERTIFICATE, GEM GRADING REPORT, GUARANTEE, AND METHOD OF GUARANTEEING JEWELRY

[76] Inventor: Hiroaki Yoshizawa, 3-6-4 Ichikawaminami, Ichikawa, Chiba, Japan

[21] Appl. No.: 08/966,421

[22] Filed: Nov. 7, 1997

[30] Foreign Application Priority Data

Nov. 11, 1996 [JP] Japan ..... 8-314181

[51] Int. Cl.[6] ..... B42D 15/00

[52] U.S. Cl. ..... 283/70; 283/74

[58] Field of Search ..... 283/67, 70, 74, 283/75, 117, 56

[56] References Cited

U.S. PATENT DOCUMENTS

| | | | |
|---|---|---|---|
| 4,527,895 | 7/1985 | Rubin | 283/70 |
| 4,913,284 | 4/1990 | Versaci | 283/74 |
| 5,267,756 | 12/1993 | Molee et al. | 283/74 |

*Primary Examiner*—Willmon Fridie, Jr.

*Attorney, Agent, or Firm*—Wenderoth, Lind & Ponack, L.L.P.

[57] ABSTRACT

A gem certificate comprising identification data based upon the examination of precious stones and precious metals used in jewelry. The gem certificate further has appearance data on the jewelry including at least two or more pictures or figures of the jewelry, and date data including the date of issue of the gem certificate and/or an issuing number.

13 Claims, 4 Drawing Sheets

1

GEM CERTIFICATE, GEM GRADING REPORT, GUARANTEE, AND METHOD OF GUARANTEEING JEWELRY

BACKGROUND OF THE INVENTION

1. Field of the Invention

The present invention relates to a gem certificate, a gem grading report and a guarantee for jewelry, and further relates to a method of guaranteeing jewelry.

2. Description of the Related Art

Jewelry such as a precious stone ring manufactured by setting a diamond on a precious metal such as eighteen-carat gold and precious metal products such as a necklace manufactured by only a precious metal tend to reach a high retail price finally because of the high cost material itself. Therefore, in general, in purchasing jewelry, the public consumer who seldom has a special knowledge about precious stones and precious metals asks the seller a gem certificate ( written identification ) to certify the genuineness of the precious stones and precious metals which are used in the jewelry by measuring or examining them in the standard gem identification method, or a gem grading report ( written valuation ) to estimate the quality grades of the diamond or the precious stones by measuring or examining them in the standard gem grading method, or a written guarantee for showing only the genuineness of the precious stone or the like in a simple way.

And it is common that one picture showing the appearance of said jewelry is attached to the gem certificate or the like as a means to certify that the jewelry which are examined at the gem laboratory or the jewelry store is the same identically jewelry that the public consumer actually get in hand. Generally, as shown in FIG. 1, such pictures are photographed diagonally the said jewelry from the upper position.

But the jewelry such as a jewel ring or the like are worn for the purpose of decorating human bodies and clothes, and therefore, not only the beauty of the precious stones, public attention is also paid to the design of the jewelry form manufactured from precious metals. Especially, the aforesaid jewelry accompanied by a gem certificate, a gem grading report or a guarantee for sales are usually a high-quality ring, necklace or the like and occasionally they are designed by a jewelry designer and manufactured individually by a jewelry craftsman.

However, even for such high-priced jewelry, only one picture of the jewelry photographed diagonally from upper position is attached to the gem certificate or the like as a data indicating the external appearance of the jewelry.

For this reason, even for the aforesaid jewelry designed and manufactured individually by, it is impossible to look at or check the opposite and the rear portions of said jewelry by said only one picture put on the gem certificate or the like, which also makes it very difficult to specify completely the design of the jewelry by the third party afterwards. That means, although the gem certificate or the like is originally issued for the purpose of guaranteeing the value of the jewelry, a prior guaranteeing method by the gem certificate or the like has a disadvantage to specify about the jewelry design which is one of the most important element for the beauty of the jewelry.

Consequently, even if an excellent jewelry design is created at the jewelry manufacturing stage, there is no possibility that the jewelry design is protected by the gem certificate or the like which is usually issued at the sales of the jewelry, imitating and stealing of the jewelry designs occurs easily, and in the worst cases, the original designer or manufacturer of the jewelry can become unclear afterwards. This causes less original jewelry brands and less original jewelry designs in the trade, which also leads to stay low in the international level of the jewelry designs compared to some other fashion fields such as clothes.

SUMMARY OF THE INVENTION

Accordingly, the present invention has been developed with a view to eliminate such problems and disadvantages involved in the prior gem certificate or the like, and it is an object of the present invention to provide a gem certificate, a gem grading report and a guarantee which are capable of guaranteeing not only precious stone and precious metals which are used in jewelry but also protecting the designer and the manufacturer from being imitated and being stolen the designs of the jewelry by using an appearance data which is enable to specify the jewelry designs, and further provide a method of guaranteeing jewelry and protecting the designer and the manufacturer of the jewelry.

For this purpose, in accordance with the present invention, there is provided a gem certificate, a gem grading report or a guarantee, in addition to an identification data or an evaluation data based upon the examination of a precious stone and a precious metal used in jewelry, including an appearance data on the jewelry having at least two or more pictures or figures, and a date data of the gem certificate, the gem grading report or the guarantee such as issuing date or an issuing number.

Furthermore, in accordance with the present invention, there is provided a method for guaranteeing a jewelry through a gem certificate, a gem grading report or a guarantee in which, in addition to identification data or evaluation data based upon examination of a precious stone used in a jewelry or the like, including an appearance data of the jewelry having at least two or more pictures or figures of the jewelry and a date data such as issuing date or an issuing number.

BRIEF DESCRIPTION OF THE DRAWINGS

The object and features of the present invention will become more readily apparent from the following detailed description of the preferred embodiment taken in conjunction with the accompanying drawings in which.

DETAILED DESCRIPTION OF THE INVENTION

Figure 1:
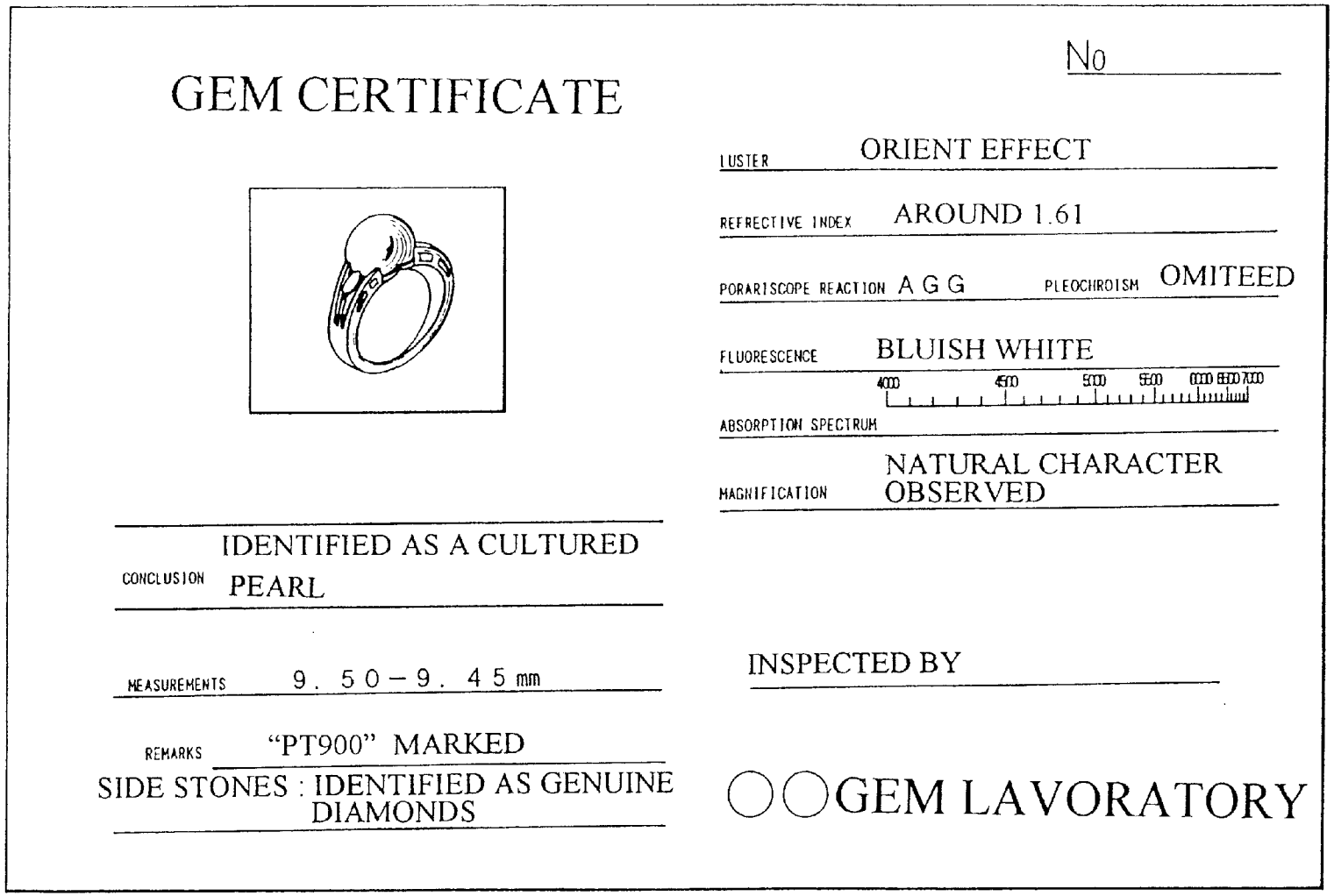
FIG. 1 is a plan view showing one example of prior gem certificate.

Referring to the drawings, a description will be made herein below of a preferred embodiment of the present invention.

Figure 2:
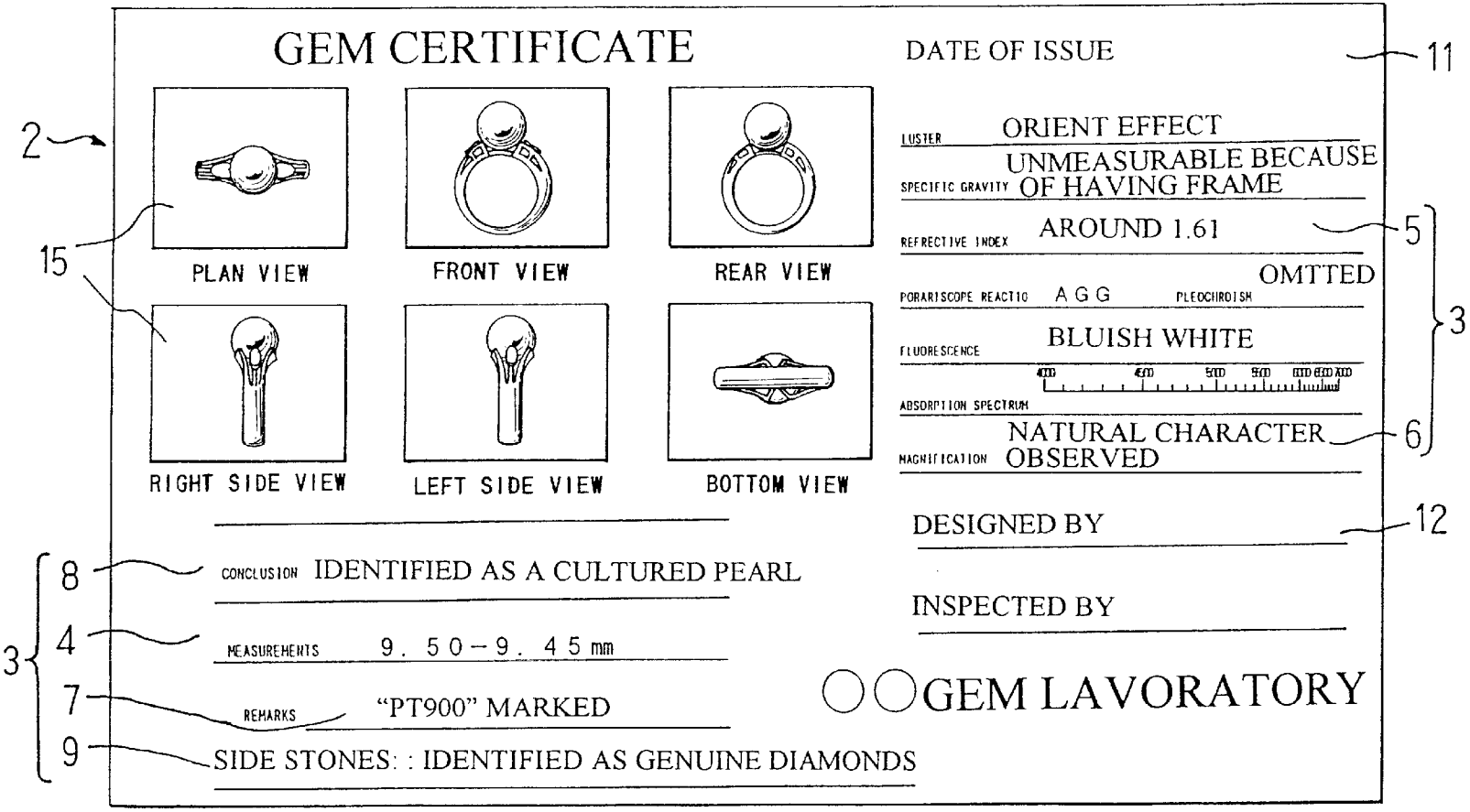
FIG. 2 is a plan view showing a gem certificate according to a preferred embodiment of the present invention.

FIG. 2 is a plan view showing a gem certificate according to this invention showing an arrangement of a gem certificate, generally designated at numeral 2, for a cultured pearl ring, for example.

As shown in FIG. 2, the gem certificate 2 has an identification data 3 comprising a specification of the precious stone of the cultured pearl, such as measurements 4, refractive index 5, magnification 6 (examination under the microscopic) and other data which are resulted from the examination of the ring by the standard gem identification, a statement 7 about the material itself of a precious metal, such as "marked PT900", a conclusion 8, such as "identified as a cultured pearl", and a statement 9 about side stones such as "identified as a natural diamond".

In addition, the date of issue of the gem certificate is written in a right and upper portion as date data 11, also a name and a signature 12 of a gemologist (or examiner), a designer (or manufacturer) or the like is put in a left and lower portion.

Moreover, in a left and upper portion, there are put a plan view based upon a picture of the pearl ring photographed from the above side, a front elevational view of the pearl ring based upon a picture taken from the front side, a rear elevational view using a picture of the pearl ring taken from the rear side, right and left side elevational views using pictures of the pearl ring taken from the side directions, and a bottom view using a picture of the pearl ring taken from the bottom side. The appearance data 15 is explained as means to specify the designs of the pearl itself, ring prongs portion, ring setting portion, ring arm portion and other designs of the pearl ring on the basis of the 6 pictures. For specifying the designs of the pearl ring exactly, the 6 pictures of the appearance data 15 are photographed at the point where the pearl ring has the same distance from a camera, thus assuming the same contraction scale.

According to this invention, when dealing with a precious stone other than the cultured pearl in the gem certificate, some data such as the numeric values of the measurements 4 and the name of the precious stone identified 8 become different in the identification data 3, but, naturally, the basic arrangements by the standard gem identification method are the same. For instance, in the case of a genuine diamond ring, the statement of "identified as a genuine diamond" is put therein.

Figure 3:
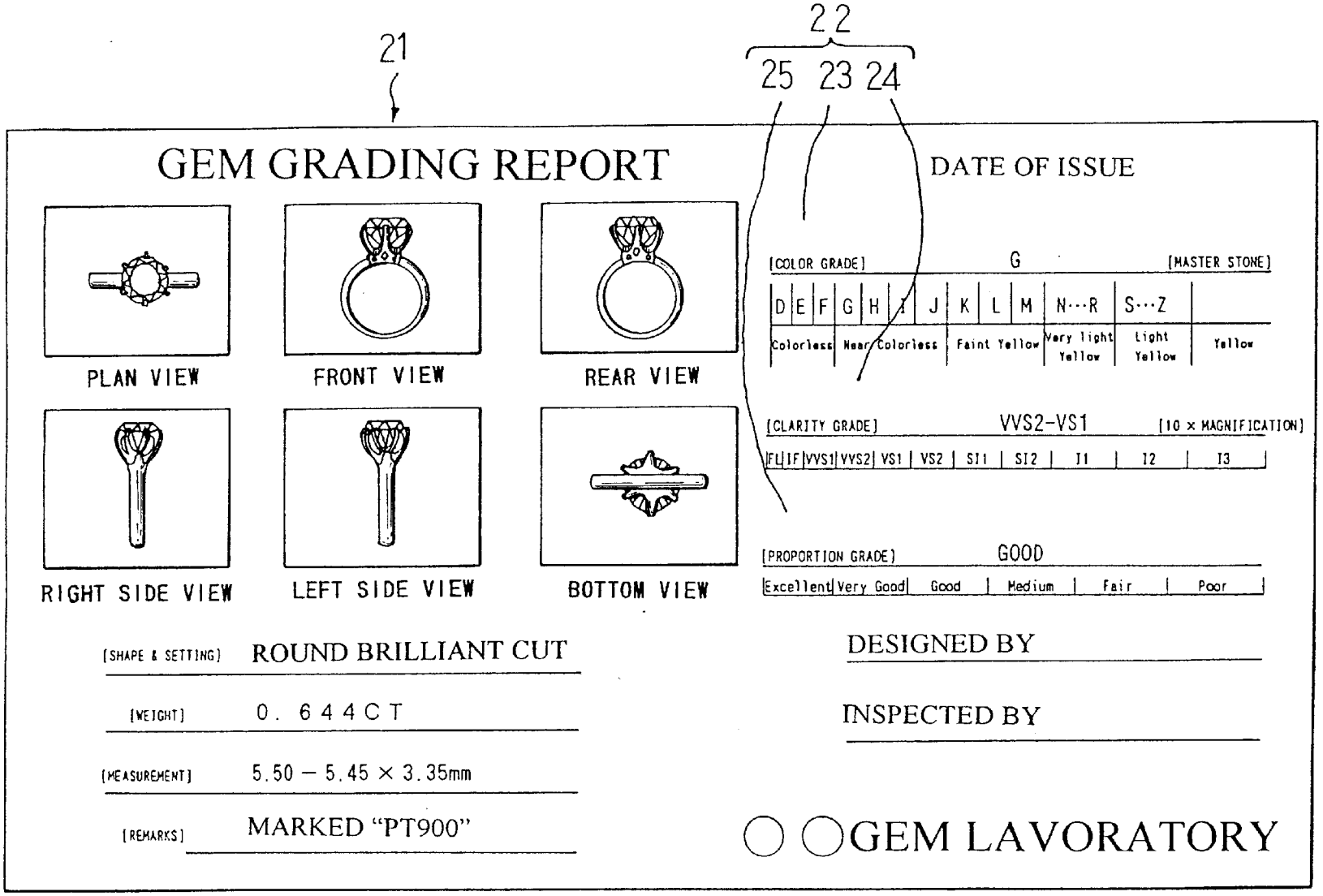
FIG. 3 is a plan view showing a gem grading report according to the preferred embodiment of this invention.

As shown in FIG. 3, the gem grading report 21 according to this invention, has the evaluation data of a diamond or some other precious stone in a quality grade is written instead of the identification data 3 of the gem certificate 2. For example, in the gem grading report 21, a diamond is graded by the standard of Gemological Institute of America which is one of the international diamond grading standard. The evaluation data 22 are classified into three categories of the grades such as the color grade (transparency) 23 is "G", the clarity grade (inclusion) 24 is "VVS2–VS1", and the proportion grade (diamond cut evaluation) 25 is "GOOD". The other arrangements such as the appearance data and the date data are the same as that of the aforesaid gem certificate 2.

Also for the other precious colored stones, such as ruby or sapphire, the color grade by the standard of Gemological Institute is written in the gem grading report for instance.

Figure 4:
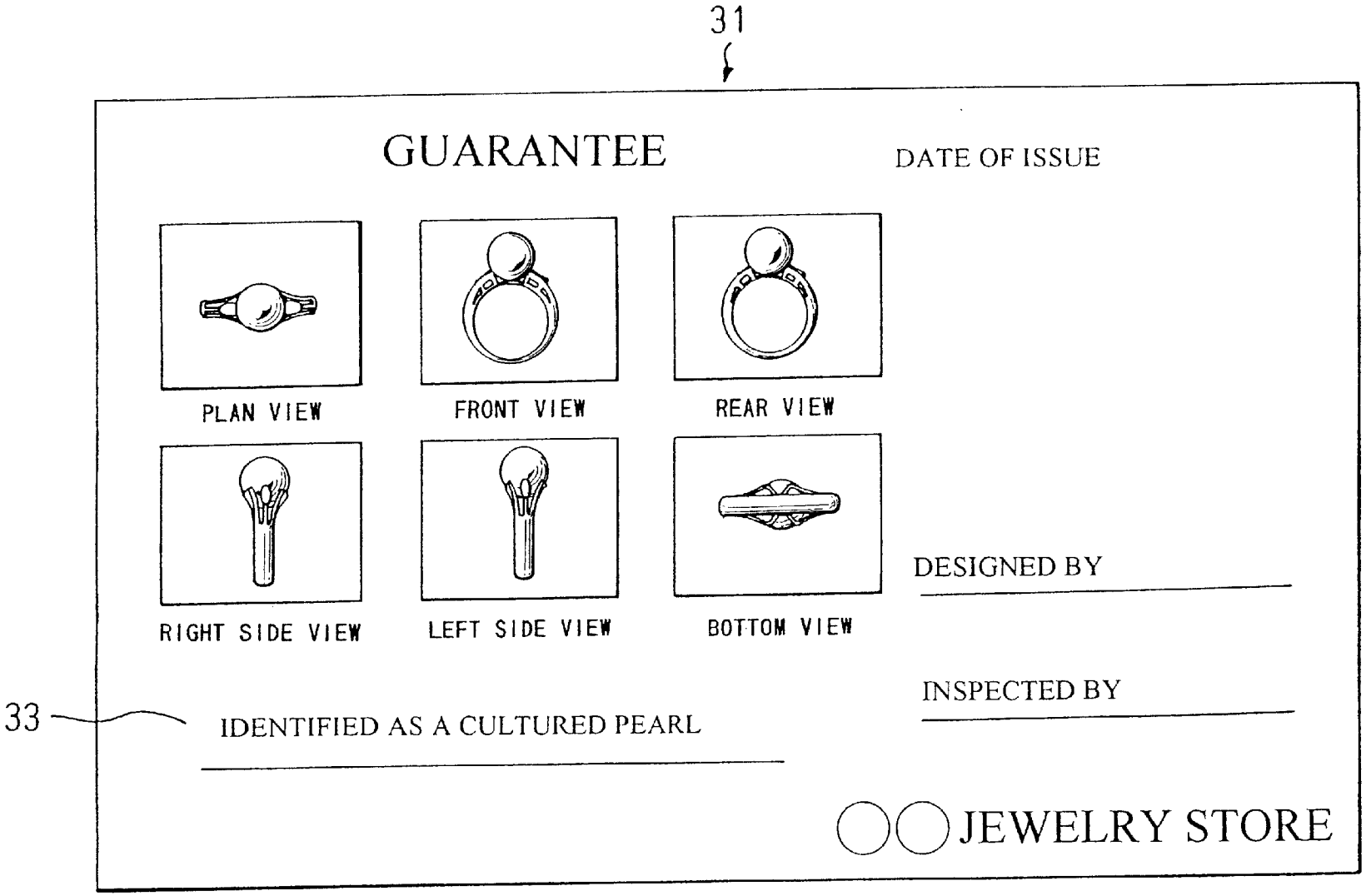
FIG. 4 is a plan view showing a guarantee according to the preferred embodiment of this invention.

Still further, as shown in FIG. 4, the guarantee 31 according to this invention has a simple identification statement 33 such as "identified as a genuine pearl" as a conclusion of the examination for the precious stones which are used in the jewelry.

Similarly, in the case of a guarantee for precious metal products such as a necklace and a bracelet, the kind of the precious metal, for example, "identified as eighteenth-carat gold", is written as a simple identification statement.

For the actual jewelry sales, when the term from the manufacturing to the sales of the jewelry is too long, it is often considered by the public consumer as an old fashioned design since nobody haven't purchased it long time. To avoid this situation, it can be preferable not to be mentioned the date of issue of the gem certificate or the like. In this case, an issuing number or the like is written in the gem certificate 2, the gem grading report 21, and the guarantee 31, which makes possibly the issue date to be recognized afterwards as the date data 11. Further, it is desirable to acquire the authentication about the date data 11 from a notary office, that prevents from arising disputes with the third party about the authenticity of the date data. It is also appropriate that a copy of the gem certificate is sent by registered mail but not opened and the receipt for the registered mail is kept for future.

In this invention, various modifications are possible but not limited to the above description. For instance, in the case of a jewelry based upon the symmetric design, it is possible that the sentences "the front elevational view is the same as the rear elevational view" and "the right side elevational view is the same as the left side elevational view" are stated in the gem certificate 2, the gem grading report 21, and the guarantee 31 and only each one sides of the pictures are placed as the appearance data 15.

Furthermore, in the case of a jewelry such as a necklace and a bracelet having a plane configuration, the design can be specified by only two pictures taken from the upper position and side position, and therefore, in this case, it is also possible that two pictures respectively constituting the plan view and the side view are used as the appearance data 15.

The appearance data 15 is not limited to a special means such as long as the third party can specify the design of the jewelry. More specifically, not only the photographs of the jewelry but also 6 diagrammatic figures in the same contraction are acceptably drawn by the orthographic drawing. In addition, it is also appropriate and more convenient to use a digital camera and the appearance data 15 is possibly recorded in an optical disk coming with the gem certificate 2, the gem grading report 21, and the guarantee 31.

Moreover, if necessary, it is also appropriate that a jewelry craftsman who actually took the charge of the manufacturing and processing the jewelry, the name of the jewelry manufacturing company, the jewelry sales company or the like are written with the name of the designer in the gem certificate 2, the gem grading report 21, and the guarantee 31, which makes clearer the distribution and the relationship of the protecting right of the jewelry.

Employing the gem certificate or the like according to this invention, it is possible not only to guarantee the precious stones used in a jewelry through the identification data but also to specify the design of the jewelry completely by the appearance data, and which is one of the most important element for the beauty of the jewelry.

Furthermore, since the date of issue of the gem certificate or the issuing number or the like corresponding thereto is simultaneously written therein, it is possible to certify that the intellectual property such as the copyright of the design of the jewelry was established at least before that issue date which is specified by the date data. This allows the design of the jewelry to be prevented from being imitated and being stolen by the third party easily, and when if a dispute arises, the copyright of the jewelry gives the legal protection to the designer and others who are specified in the gem certificate or the like to this invention.

Still further, in the case of the so-called a high-quality jewelry handmade by a jewelry craftsman, the image of the preciousness of the jewelry is increased by the gem certificate or the like to this invention because the customer who purchased the handmade jewelry with the gem certificate or the like according to this invention, can obtain a satisfaction as that jewelry is only one existed in the entire world, which also contributes to sales promotion of the handmade jewelry.

Although the design protection based upon the design patent law is very strong, the design law is not always suitable completely for the jewelry design because the fashion style has a very short life cycle and, therefore, not many jewelry designer and jewelry company have not been depending on the design patent law for protecting their jewelry design.

Considering this situation and that is the gem certificate or the like is usually provided at the sales of the high-priced jewelry, the legal protection of the design of the jewelry based on the copyright due to the gem certificate or the like of this invention can provide a great significance in the jewelry industry.

The gem certificate or the like of this invention also can promote the creation of an excellent design of a jewelry and can contribute to the development of the jewelry design with a more originality, which is expected to improve the international level of the jewelry design.

It should be understood that the foregoing relates to only a preferred embodiment of the present inventions and that it is intended to cover all changes and modifications of the embodiment of the invention herein used for the purpose of the disclosure, which do not constitute departures from the spirit and scope of the invention.

What is claimed is:

1. A gem certificate comprising:

identifying data based upon an examination of precious stones or precious metals used in an article of jewelry, appearance data of the article of jewelry, said appearance data including at least two photographs or drawing figures of the article of jewelry, and date data including at least one of a date of issuance of said gem certificate or a gem certificate issue number.

2. The gem certificate as claimed in claim 1, wherein said identifying data includes at least measurements of the precious stones, refractive index of the precious stones, and observations obtained under magnification of the precious stones.

3. The gem certificate as claimed in claim 2, wherein said appearance data includes a plan view of the article of jewelry, a front elevational view of the article of jewelry, a rear elevational view of the article of jewelry, right and left side elevational views of the article of jewelry, and a bottom view of the article of jewelry.

4. The gem certificate as claimed in claim 3, wherein said certificate further includes a signature block for identifying the designer or manufacturer of the article of jewelry and for identifying the entity who performed the examination of the article of jewelry.

5. A gem grading report comprising:

evaluation data based upon an examination of diamonds or precious stones used in an article of jewelry;

appearance data of the article of jewelry, said appearance data including at least two photographs or drawing figures of the article of jewelry; and date data including at least one of a date of issuance of said gem grading report or a gem grading report issue number.

6. The gem grading report as claimed in claim 5, wherein said appearance data includes a plan view of the article of jewelry, a front elevational view of the article of jewelry, a rear elevational view of the article of jewelry, right and left side elevational views of the article of jewelry, and a bottom view of the article of jewelry.

7. The gem grading report as claimed in claim 6, wherein said certificate further includes a signature block for identifying the designer or manufacturer of the article of jewelry and for identifying the entity who performed the examination of the article of jewelry.

8. A gem guarantee comprising:

appearance data of an article of jewelry, said appearance data including at least two photographs or drawing figures of the article of jewelry; and date data including at least one of a gem guarantee issue date and a gem guarantee issue number.

9. The gem guarantee as claimed in claim 8, wherein said appearance data includes a plan view of the article of jewelry, a front elevational view of the article of jewelry, a rear elevational view of the article of jewelry, right and left side elevational views of the article of jewelry, and a bottom view of the article of jewelry.

10. The gem guarantee as claimed in claim 9, wherein said certificate further includes a signature block for identifying the designer or manufacturer of the article of jewelry and for identifying the entity who performed the examination of the article of jewelry.

11. A method of identifying an article of jewelry, wherein said method comprises:

examining an article of jewelry to obtain identification data regarding at least one of precious stones or precious metals used in the article of jewelry;

recording said identification data on a certificate;

obtaining appearance data of the article of jewelry, said appearance data including at least two photographs or at least two drawing figures;

providing said appearance data on the certificate; and providing date data on the certificate, said date data including at least one of a certificate issue date or a certificate issue number.

12. The method as claimed in claim 11, further comprising issuing the certificate, with a purchase of the article of jewelry, as a gem certificate, a gem grading report, or a guarantee.

13. The method as claimed in claim 11, wherein said step of providing appearance data includes providing on said certificate a plan view of the article of jewelry, a front elevational view of the article of jewelry, a rear elevational view of the article of jewelry, right and left side elevational views of the article of jewelry, and a bottom view of the article of jewelry.

* * * * *